United States Patent [19]

Lipsker et al.

[11] Patent Number: 4,957,175

[45] Date of Patent: Sep. 18, 1990

[54] SOIL DRILLING EQUIPMENT

[76] Inventors: Yitshaq Lipsker; Boris Prokupetz, both of 24 Trumpeldor Street, 47264 Ramat Hasharon, Israel

[21] Appl. No.: 344,388

[22] Filed: Apr. 28, 1989

Related U.S. Application Data

[63] Continuation-in-part of Ser. No. 859,493, May 5, 1986, abandoned, and Ser. No. 51,429, May 19, 1987, abandoned.

[30] Foreign Application Priority Data

May 10, 1985 [IL] Israel ..... 75160

[51] Int. Cl.[5] ..... E21B 4/18; E21B 7/02

[52] U.S. Cl. ..... 175/94; 175/99

[58] Field of Search ..... 299/31; 175/92, 94, 175/97, 98, 99, 103, 202, 203

[56] References Cited

U.S. PATENT DOCUMENTS

| | | | |
|---|---|---|---|
| 4,102,415 | 7/1978 | Cunningham | 175/99 X |
| 4,396,072 | 8/1983 | Hurtz et al. | 175/94 X |
| 4,474,253 | 10/1984 | Kleuters | 175/94 |

FOREIGN PATENT DOCUMENTS

| | | | |
|---|---|---|---|
| 2722075 | 12/1978 | Fed. Rep. of Germany | 175/94 |
| 3111090 | 9/1982 | Fed. Rep. of Germany | 175/94 |
| 663279 | 4/1929 | France | 175/103 |

*Primary Examiner*—Jerome W. Massie
*Assistant Examiner*—David J. Bagnell
*Attorney, Agent, or Firm*—Fleit, Jacobson, Cohn, Price, Holman & Stern

[57] ABSTRACT

For the drilling of bore holes there is provided an assembly of drilling machine elements which are positioned on top of each other and which include a gripping body comprising of two or more shells between which are positioned expanding-contracting cylinders for causing the shells to be pressed against the wall of a hole being drilled, a hollow drive shaft and a drilling tool being suspended below the gripping body. In addition to the above mentioned gripping body which acts outwardly of the center of the assembly, there are provided gripping plates which act radially inwardly of the hollow drive shaft to grip the stem of the drilling tool, which extends within the hollow drive shaft.

9 Claims, 6 Drawing Sheets

SOIL DRILLING EQUIPMENT

CROSS REFERENCE TO RELATED APPLICATION

This is a continuation-in-part of applications Ser. No. 859,493 filed May 5, 1986, now abandoned, and of Ser. No. 051,429 filed May 5, 1986, and of Ser. No. 051,429 filed May 19, 1987, now abandoned the contents of both of which are specifically incorporated herein by reference.

FIELD AND BACKGROUND OF INVENTION

The present invention relates to machinery for use in drilling bore holes in the soil by means of drilling tools adapted for use in various strata. The machinery is designed inter alia for drilling holes at locations where due to scarcity of space large size machinery cannot be used. The machinery can also be used in making piles to support high rise building structures. However, the machinery according to the invention can and does perform further tasks which are incidental to piling. Further the machinery can be used also, when properly adapted, to drilling bore holes of alternatingly varying diameter.

Conventionally, e.g. when preparing substructures, especially piles to serve as supports or foundation of high rise building, first, a test bore is drilled down to the depth of the future bore, and soil samples are extracted from a number of strata. The samples are evaluated by geologists and/or soil engineers. The opinion of these experts then serves as a starting point for devising and planning the actual bore in which the piles are to be cast.

When drilling through different strata of a soil formation it is frequently necessary to use different types of drilling tools which result in varying diameters of the bore hole.

Generally the machinery according to the invention is destined to make vertical bore holes, as well as horizontal ones, and such which extend at an angle relative to the vertical and the horizontal.

OBJECT OF INVENTION

It is an object of the invention to provide drilling means which can be used at practically any site, even indoors, e.g. in cellars. It is also an object of the invention to provide means which make the preliminary test drills superfluous and permit testing and evaluation of the soil strata at the respective site, simultaneously with and progressing at the same rate as the actual drilling proceeds.

Another important object of the invention is to provide a wholly self-contained drilling apparatus which can be used to drill bore holes and the like substantially from start to finish independently of and without the need for one piece of drilling equipment to start the hole and another piece to continue the drilling.

For that reason the machinery according to the invention includes means exerting both sidewise and downward pressure.

It is a further object of the invention to provide machinery of the kind referred to above which can be used in connection with different drills of various types and which permits the connection of such different drills to the equipment in an easy and quick way.

It is yet a further object of the invention to provide a machinery which permits making consecutive and alternating portions of the bore hole of different diameters.

SUMMARY OF THE INVENTION

According to one aspect of the invention, there is provided an assembly of drilling elements superposed to one another and functionally interconnected, such assembly being associated with a structure to be erected at the site of a drilling operation, the assembly comprising at least one each of the following elements:

(a1) a cylindrical or prismatic laterally expandable and contractible gripping body composed of two or more shells enclosing a space within which a first set of pneumatic or hydraulic cylinders is located, such cylinders acting on said shells for urging them outwardly thus widening the space enclosed by the said shells;

(a2) a like gripping body comprising a second set of cylinders acting inwardly relative to drive means;

(b) a third set of pneumatic or hydraulic cylinders acting on the drilling tool in downward direction;

(c) a drive means such as an electrical or hydraulic or pneumatic motor suspended from the said cylindrical or prismatic body; and (d) a drilling tool such as an auger or like implement which is connected by an appropriate drive shaft with the said drive.

According to a further feature of the invention, pressure measuring instruments may be connected with the cylindrical or prismatic body to indicate the degree of pressure exerted by the shells on a fixed surface, for example, the wall of a bore hole.

According to yet another feature the new machinery which is suspended from a cable comprises a hollow drive shaft to which a drilling tool can be connected functionally, a drive for the said shaft to impart its rotational movement, means to exert lateral pressure towards the wall of the bore hole so as to prevent torsional movement of the suspended equipment, means for exerting vertically directed pressure on the drill and pressure means for exerting pressure from at least two sides horizontally directed towards the said hollow drive shaft for connecting and holding drilling tools at the lower end of the shaft.

In a practical embodiment of this variant of the invention the drive for the hollow shaft is constituted by two synchronized electrical or hydraulic motors positioned at the top of the shaft and which are drive connected with the shaft via appropriate gears of toothed wheels.

According to yet another feature of the invention the said means for exerting lateral pressure onto the wall of the bore hole are a number of hydraulic (or pneumatic) cylinders the piston rods of which carry curved plates which in the extended position of the piston rods are forcibly pressed against the bore hole wall. The means for exerting pressure towards the drive shaft are at least two oppositely disposed hydraulic or pneumatic cylinders.

The vertical pressure urging the drilling tool downwardly are hydraulic (or pneumatic) cylinders which extend at the exterior of the hollow shaft whenever such is employed and act on an annular member surrounding the shaft which member is functionally connected via a pressure bearing with a collar also surrounding the shaft.

These and further features of the invention will become clear from the following detailed description which relates to preferred embodiments of the invention.

The attached drawings illustrate by way of examples such preferred embodiments but those skilled in the art would easily understand that parts of the shown construction could be substituted by equivalents without departing from the gist of the invention.

Preferably, in accordance with the invention, the assembly of drilling elements may be associated with a structure to be mounted on a surface into which a hole is to be drilled, so that the gripping body can react against the structure to commence drilling, and then move from the structure into the drilled hole when appropriate.

DETAILED DESCRIPTION OF PREFERRED EMBODIMENT

Figure 1:
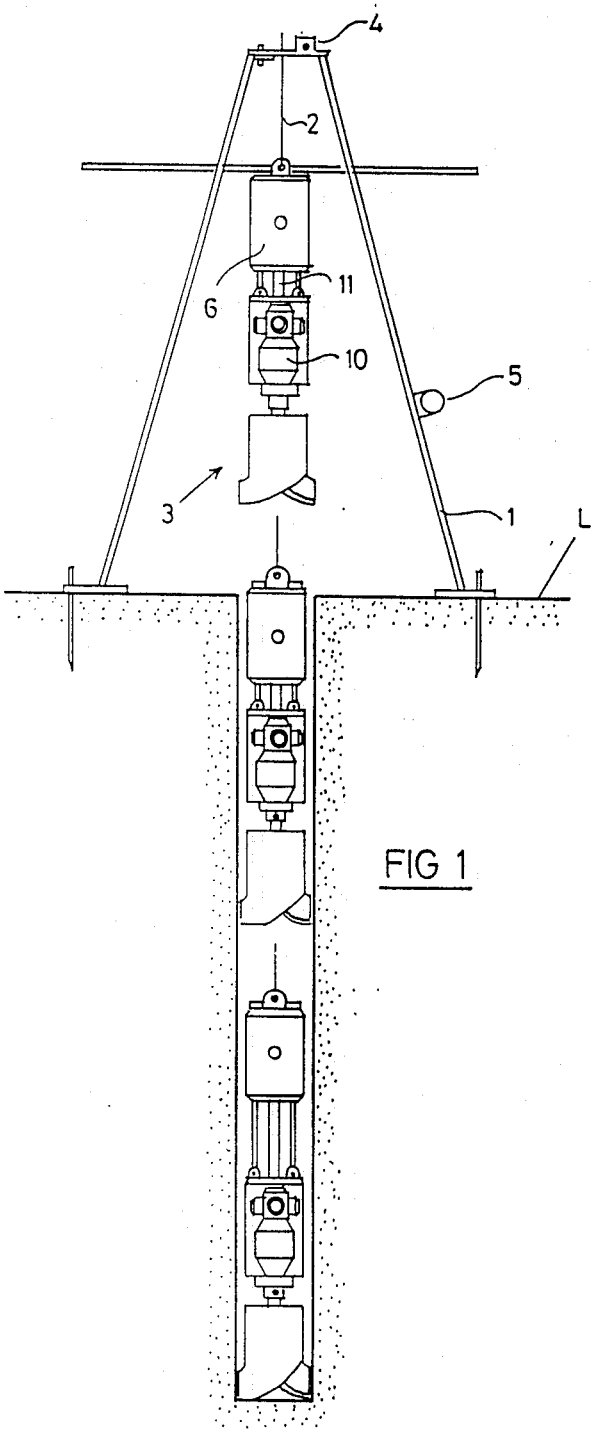
FIG. 1 is a composite elevational view of a first embodiment drilling apparatus showing the apparatus in different stages prior to entry into and within a bore hole.
Figure 2:
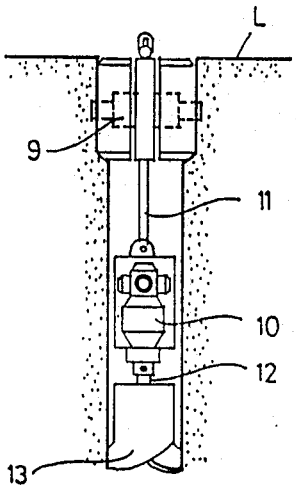
FIG. 2 is an elevational view of the apparatus with the cylindrical gripping body in operation position.

Referring initially to FIGS. 1 and 2, at the site where a bore hole is to be drilled, a supporting structure, such as a tripod 1 in FIG. 1, is erected, and from it is suspended by a cable 2 an assembly of drilling machinery indicated as a whole by the numeral 3.

The assembly can be raised or lowered by means of a cable 2 which is led over an idle pulley 4 at the top of tripod 1 to a reel 5 onto which by rotating it in a conventional way the cable is wound or unwound.

The uppermost constituent in the assembly 3 is a cylindrical gripping body 6 which consists of two semicircular shells 7 which face one another with their concave, open side and thus define between them a space 8 in which two pneumatic or hydraulic cylinders 9 are positioned, the pistons of which, under pneumatic or hydraulic pressure, move in opposite directions. The piston rods of the two cylinders are affixed each to one of the shells 7. Gripping bodies per se of this general type are known, and one example thereof is disclosed in U.S. Pat. No. 4,060,141.

The second element in the assembly 3 is a motor 10 (which may be an electrical motor if current would be available at the respective site, or a pneumatic or hydraulic engine which obtains the drive fluid via a conduit (not shown) leading from cylinders 9).

The motor 10 operates via a drive shaft 12 to drive an auger 13 which is the lowermost element in the assembly and which may also be of a type known per se.

A second set of pneumatic or hydraulic cylinders with extending piston rods 11 exerts downward acting pressure on the unit comprising the motor 10 and auger 13 (or any other tool which might be used instead of an auger).

As already mentioned, body 6, instead of being cylindrical, may be prismatic. It may consist of more than two shells. Instead of an auger, as shown, any other conventional drilling tool may be used.

The arrangement functions as follows: The structure 1 having been placed and immobilized in situ, drilling is commenced and the assembly 3 is lowered into the uppermost portions of a bore hole until body 6 is just below the level L of the ground. Now pressure fluid is directed to cylinders 9 resulting in moving the pistons outwardly of the cylinders 9, so that the shells 7 are pressed towards the wall of the bore hole, as shown in FIG. 2.

In this way, two effects are obtained:

First, the whole assembly 3 is fixedly held so that the auger 13 (or other tool) will function and, secondly, the degree of resistance or yield of the soil around body 6 may be indicated on instruments connected in a conventional way with shells 7. These indications are noted at succeeding strata and serve as data for the condition of the soil and serve the ultimate determination of the nature of piles (or other casts) to be made.

The motor 10, if electric, is fed with electrical current via cables leading to it. Obviously, there does not exist any problem in providing the necessary electrical connections. In the case that element 10 is a pneumatic or hydraulic engine, the pressure fluid fed to the cylinders 9 is also conducted to engine 10.

The drilling tool 13 is periodically raised to the surface and emptied, as is well known.

It will be seen that, by use of the assembly 3, the bore hole, as conventionally cast out, is being produced at the same time that data of soil type and nature are obtained so that preliminary test bores becomes superfluous. As the drilling proceeds, the wall of the bore hole is continuously consolidated, thus, eliminating the danger of cave-in.

While the foregoing description deals with vertical bores, those skilled in the art will understand that in the same way horizontal or oblique bores can be made.

Figure 3:
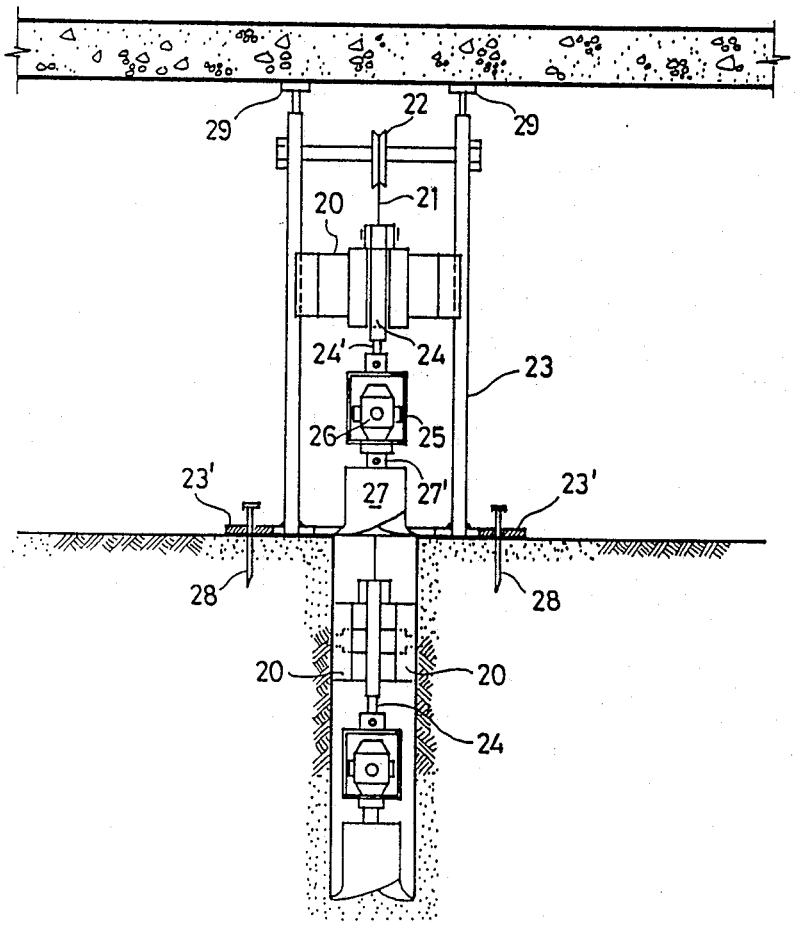
FIG. 3 is an elevational view of a drilling apparatus installed in a restricted space, e.g. the cellar of a building or a tunnel and incorporating an assembly of drilling machinery.

According to FIG. 3, there is provided an assembly of drilling machinery which is identical in principle with the one already described, but which is intended for use in severely restricted spaces, say, in a cellar of an existing building or in a tunnel. The arrangement depicted by FIG. 3 again comprises a gripping unit of several shells which as a whole is designated by the numeral 20 and which is suspended by a cable 21 slung over a pulley 22 which latter turns on the horizontal uppermost bar of a gallows-like structure 23. From a cylinder 24 held in the centre of the shell unit 20 moves outwardly a piston rod 24' to which is attached a carrying cage 25 holding an electrical motor 26 which via an appripriate coupling 27' drives an auger 27.

The whole assembly of machinery is thus suspended from pulley 22. This latter, as has been stated, turns on a horizontal bar of gallows 23, the two uprights of which are secured to the ground by spikes driven through foot plates 23' integral with said uprights. From the top of both uprights extend lengthwise adjustable rods which carry presser plates 29 forcibly pressing against the ceiling of the respective space, be it a cellar or a tunnel.

The operation of this arrangement is as follows:

The structure 23 having been erected and secured in situ by spikes 28 and presser plates 29 is now ready to carry the assembly of drilling machinery. This latter is put in place and the unit 20 of shells is expanded to exert strong pressure on the uprights of structure 23 and provide a reaction support at the commencement of drilling. Drilling can now be started from the level of the ground, the outwardly moving piston of cylinder 24 causing extension of piston rod 24' and downward movement of the auger 27.

When the piston rod 24' has been extended outwardly of cylinder 24 to its full length, the shells of unit 20 are contracted and the whole assembly is lowered into the produced bore hole, as shown in the lower portion of FIG. 3. Here, the shells of unit 20 are made to press against the wall of the hole and the procedure is repeated, the whole assembly proceeding downwardly until the piston rod 24' is extended to its full length.

Figure 4:
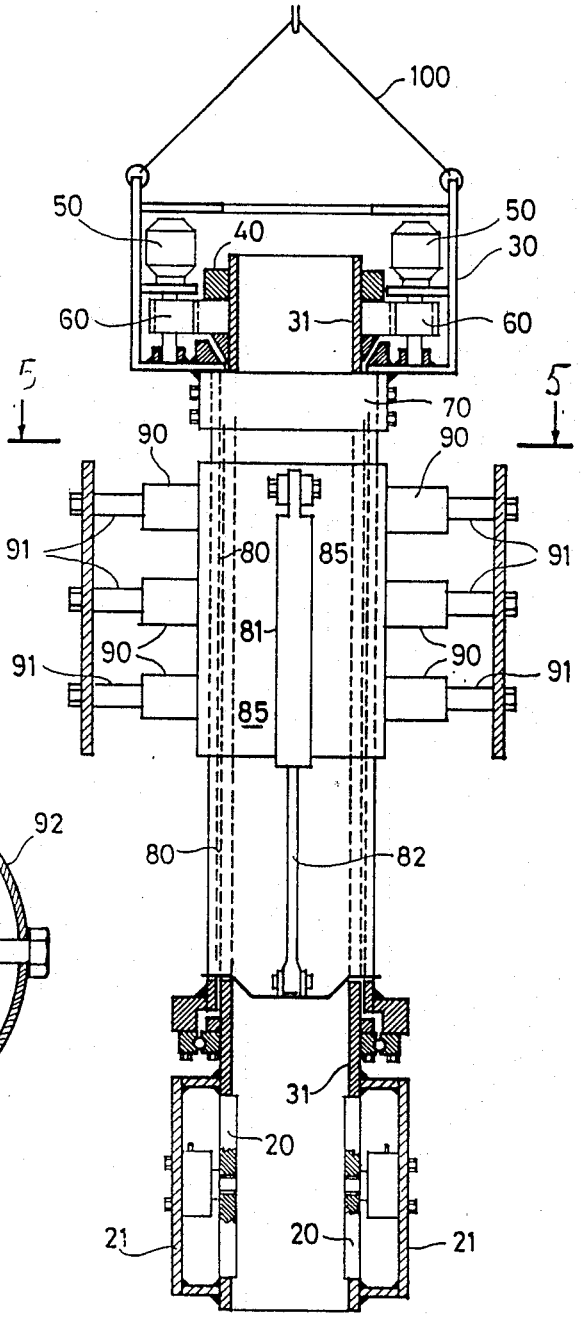
FIG. 4 shows schematically in an elevational view, partly in section the embodiment of the invention employing a hollow drive shaft.
Figure 5:
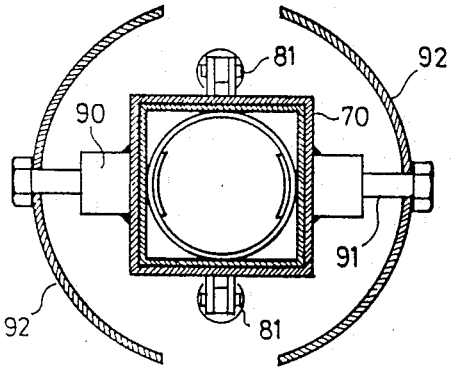
FIG. 5 is a section on line 5—5 of FIG. 4.
Figure 6:
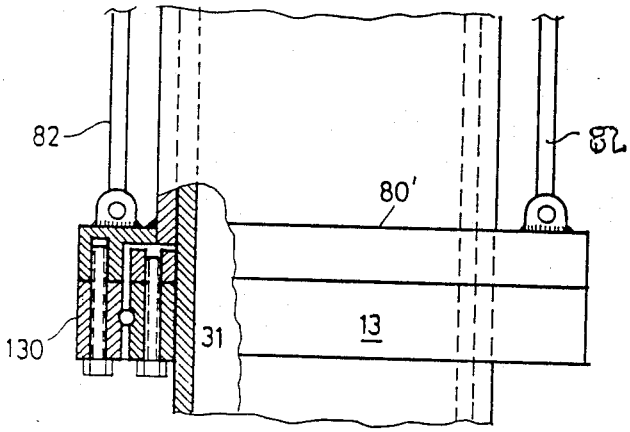
FIG. 6 is a sectional view of a detail, on a larger scale.

Turning now to FIGS. 4, 5, and 6 of the drawings there is shown the embodiments of the new drilling equipment, which as a whole is suspended from a cable 100. To cable 100 is attached a cage like structure 30 into which extends the uppermost end of a hollow shaft 31. At the said uppermost end of shaft 31 is provided a toothed wheel rim 40. In cage structure 30 are positioned two synchronized motors 50, the downwardly extending shafts of which have keyed thereon toothed wheels 60 which mesh with rim 40 and thus provide rotational drive to the hollow shaft 31. The cage 30 is fixedly connected with a square collar 70 into which it extends and with which is fixedly connected a square profiled tube 80 extending along and about hollow shaft 31 (FIG. 6) to the level indicated by line 80' which serves to stabilize the whole drilling assembly within a bore hole and to prevent undesirable torsional movement thereof. On the square tube 80 slides a square profiled sleeve 85. The member 80 is open at top and bottom to permit unimpeded passage of the hollow shaft 31 therethrough. From two opposite side walls of the sleeve 85 extend horizontal hydraulic or pneumatic cylinders 90 in which move pistons, the piston rods 91 of which carry sickle profiled sheets 92 which can be pressed forcibly against the wall of the bore hole (see FIG. 7) whenever pressure fluid is made to enter the cylinders 90. The conduits which conduct pressure fluid to the cylinders are not shown but their arrangement, being conventional, is well known.

In addition to the horizontal cylinders 90 there are fixedly attached to sleeve 85, at two opposite sides thereof, two vertical cylinders 81. From cylinders 81 extending in a downward direction are piston rods 82, the outer ends of which are applied to a thrust bearing 130 enclosing in a collar like manner the shaft 31 (see FIG. 6).

By admitting pressure fluid cylinders 81 in a conventional way (also here the pressure fluid conduits are not shown) the pistons in cylinders 81 move outwardly and pressure is exerted on bearing 130 and through it downward movement is imparted to the hollow shaft 31 and ultimately to the drilling tool proper, as will become clear.

Figure 7:
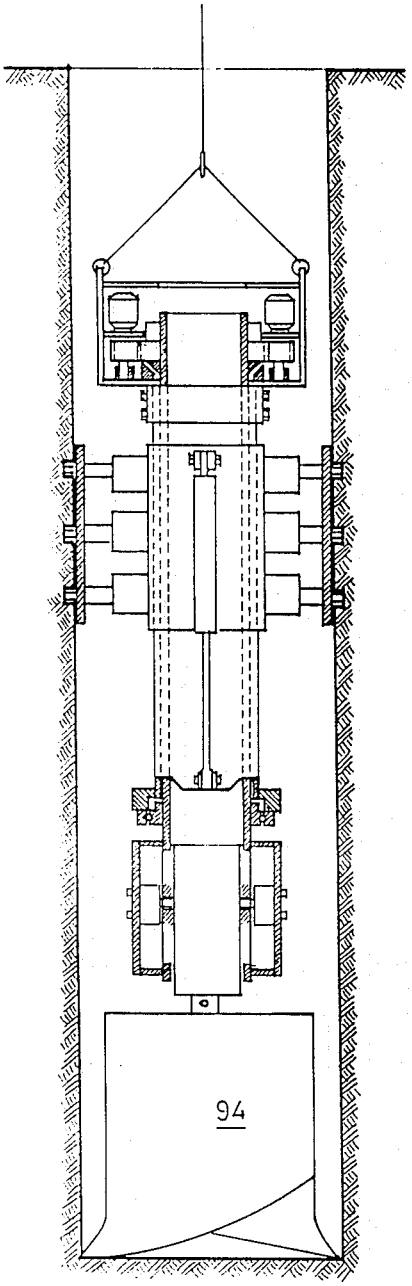
FIG. 7 is a sectional view showing the equipment of FIG. 4 with an auger as drilling tool attached thereto and being positioned in a bore hole.

The drilling tool may be any one of conventional drilling tools. By way of example FIG. 7 shows shaft 31 carrying a conventional auger 94.

Figure 8:
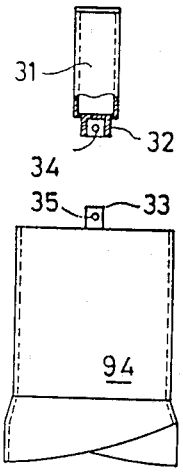
FIG. 8 illustrates a detail (drawn at smaller scale), i.e. means for attaching the auger to the equipment.

An auger may be attached to the hollow shaft 31 in whatever conventional way, one example of such means being shown in FIG. 8. Into the free end of the hollow shaft 31 is inserted, and fixedly attached to it a member 32 of square cross section. The auger itself is provided with a stud 33 extending from the centre of its top wall. The stud fits into member 32 and is secured by passing a pin (not shown) through a hole 34 in member 32 and a cross bore 35 in stud 33.

It thus can be seen that when drive to the shaft 31 is applied and downward pressure is exerted, the auger 94 (or whatever other drilling tool) is made to bore into the ground. In the case of an auger the spoil can be removed, as is well known to practice, by raising the auger and emptying it. Where the bore hole has been provided with casing, the spoil can be flushed out, as is done in such cases.

Figure 9:
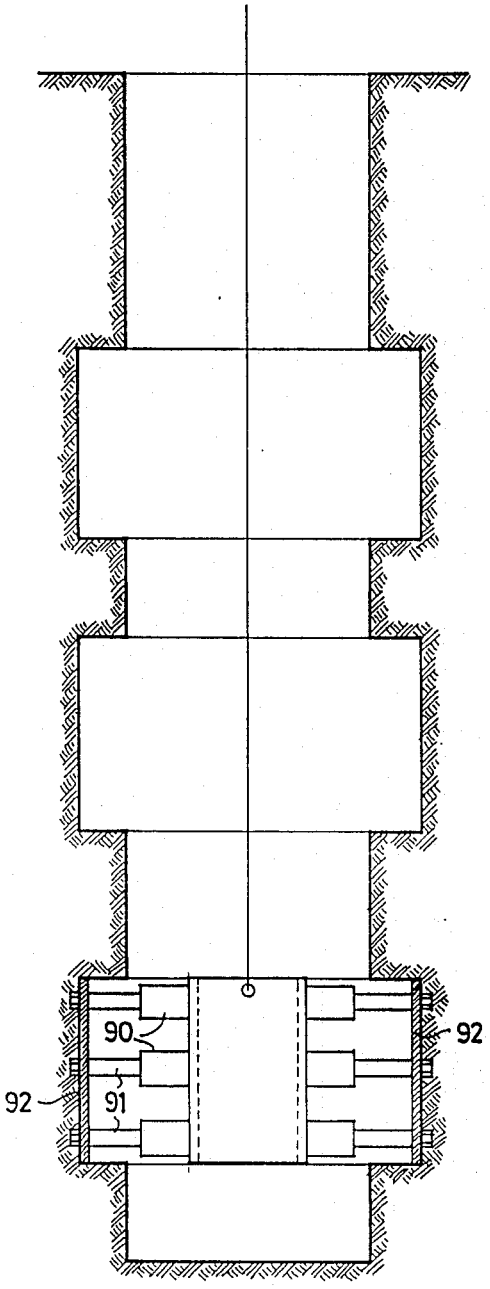
FIG. 9 is a sectional view of a bore hole in which parts of larger diameter alternate with parts of smaller diameter.

FIG. 9 illustrates an example of use of the machinery where soil conditions make it necessary, or for other reasons, that the bore hole should comprise wider sections alternating with narrower ones, this being obtained by causing the piston rods 91 to extend to a smaller or larger degree from the pistons 90, such that at their greater extension the wall of the bore hole is recessed, creating a section of larger diameter.

Figure 11:
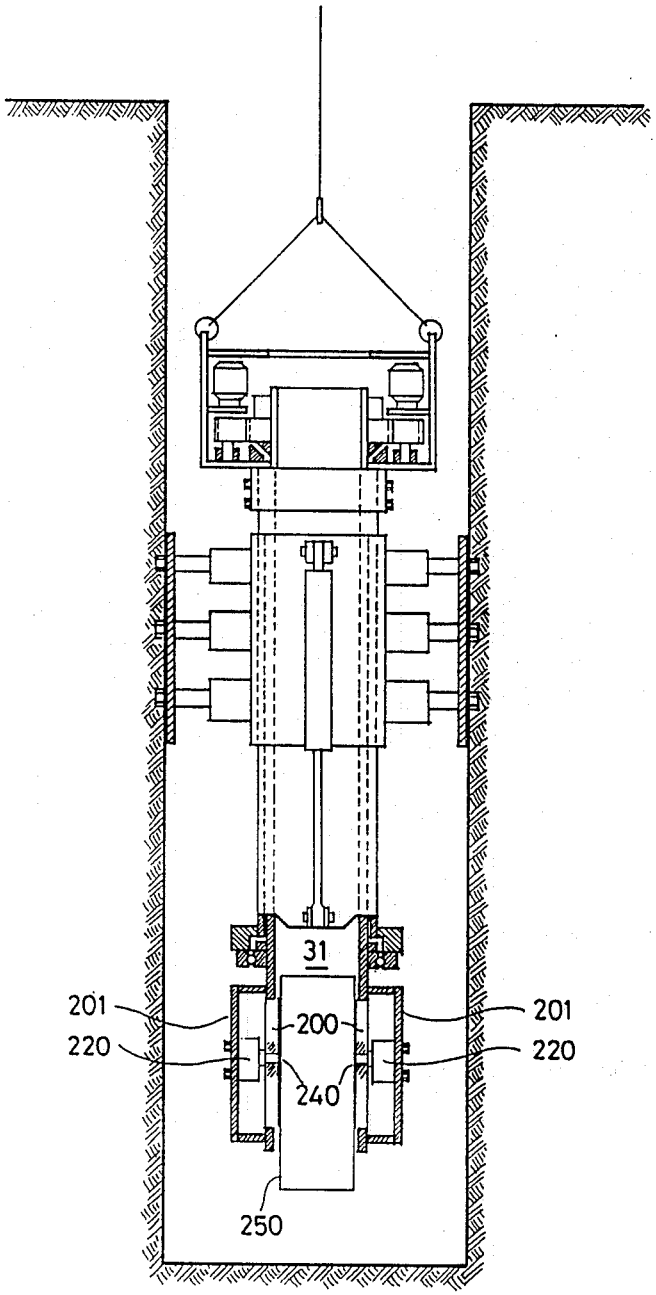
FIG. 11 illustrates the possibility of affixing different tools to the drive shaft.

Turning now to FIG. 11, there is shown a further example of employing the new drilling machinery. The upper part of the arrangement is practically identical with what has been shown in FIG. 4 and has been described in relation thereto. For that reason no detailed description of that part is deemed necessary, reference may be had to the above description.

Figure 10:
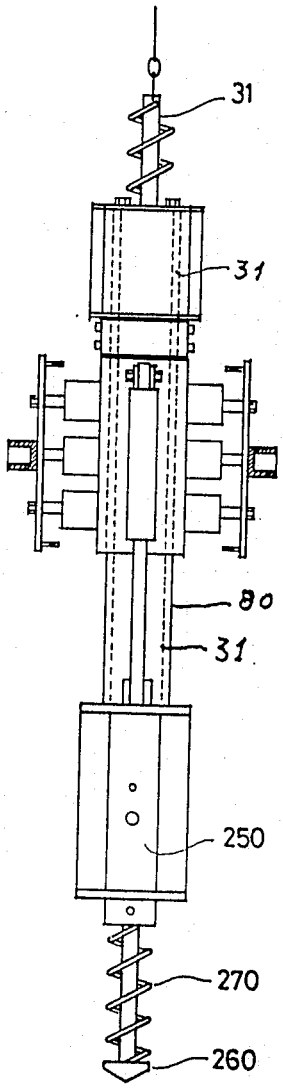
FIG. 10 shows schematically the new machinery including a spiral soil conveyor.

However at the lowermost portion of the hollow shaft 31 provision has been made for attachment of different drilling tools (instead of an auger, as heretofore described). As can be seen in FIG. 11, and also FIG. 4 oppositely disposed openings are provided in the wall of shaft 31. The said openings indicated by reference numeral 200 are enclosed, at the outside of the shaft wall, by box like enclosures 201 in which are disposed, one in each enclosure, horizontal pneumatic or hydraulic cylinders 220 from which pistons move whenever pressure fluid (through not shown conduits) is fed to the cylinders 220. These pistons have piston rods 230 carrying pressure plates 240 at their outer ends. Under fluid pressure and with the movement of the pistons, the pressure plates 240 pass through openings 200 into the interior of hollow shaft 31 so that whatever tool is found there, is gripped between the two oppositely disposed pressure plates and is firmly held there. In the example of FIG. 10 the stem 250 of a drill 260 is inserted into shaft 31 and is gripped by the two pressure plates. Stem 250 is continued both in downward and upward direction by a conventional spiral conveyor 270 which raises spoil cut by the drill to the surface. As the drilling proceeds downwardly additional spiral sections are added, which is made possible thereby that the passage through the hollow shaft 3 remains unimpeded and wholly free.

We claim:

1. An assembly of machinery for drilling bore holes in the soil, comprising:

a gripping body composed of at least two shells enclosing a space within which a first set of expansion-contraction cylinders is located, such cylinders acting on said shells for urging them outwardly relative to said space, thus widening the space enclosed by the said shells;

a drive mechanism mounted adjacent the gripping body;

a hollow drive shaft extending from said drive mechanism with said drive mechanism being located concentrically with respect to the hollow drive shaft;

a drilling tool connected by said drive shaft to said drive mechanism;

a second set of expansion-contraction cylinders acting on said drilling tool in a downward direction; and a third set of expansion-contraction cylinders acting inwardly relative to said hollow drive shaft to grip said drilling tool.

2. The assembly of machinery claimed in claim 1, further comprising oppositely disposed openings in the lowermost portion of the hollow drive shaft, and box-like enclosures at the outside of the hollow shaft at each such opening, said third set of contraction-expansion cylinders being provided within said enclosures and being positioned to cause pressure plate-carrying piston rods to enter said openings upon the admittance of pressure fluid to the cylinders.

3. The assembly of machinery claimed in claim 1, wherein said hollow drive shaft is enclosed in a square profiled tube which prevents the assembly of machinery from torsional movement.

4. The assembly claimed in claim 3, wherein said square profiled tube is surrounded by a square sleeve from opposite sides of which extend said first set of contraction-extension cylinders and from other opposite sides of which said second set of contraction-extension cylinders act in a direction normal to the direction of said first set.

5. Apparatus for drilling bore holes, comprising:

first gripping means for holding at least a portion of the apparatus against longitudinal movement in a bore hole, said first gripping means including a pair of gripping members reciprocable transversely with respect to the bore hole;

reciprocable second gripping means for gripping a drilling tool;

means for moving said second gripping means and the gripped drilling tool longitudinally in the bore hole relative to said first gripping means;

drive means for rotating said second gripping means and the gripped drilling tool; and drive shaft means for connecting said drive means to said second gripping means and the gripped drilling tool.

6. Apparatus as claimed in claim 5, wherein said first gripping means, said second gripping means and said moving means for moving said second gripping means include first, second and third fluid cylinder-operating mechanisms, respectively.

7. Apparatus as claimed in claim 6, wherein:

at least an end of said drive shaft means adjacent said drilling tool second gripping means includes openings on opposite sides of said drive shaft means;

box-like enclosures are provided on said drive shaft means adjacent the openings;

respective ones of said second fluid cylinder operating mechanisms are mounted in said box-like enclosures; and pressure plates are provided on piston rods of said second fluid cylinder operating mechanisms and are receivable in the openings in said drive means in response to operation of said second fluid cylinder operating mechanisms.

8. Apparatus as claimed in claim 6, wherein said drive shaft means is enclosed in a tube of square cross-section for preventing torsional movement of the apparatus.

9. Apparatus as claimed in claim 8, wherein said tube of square cross-section is surrounded by a sleeve of square cross-section from opposite sides of which respective ones of said first fluid cylinder operating mechanisms extend, and from opposite sides of which respective ones of said third fluid cylinder operating mechanisms extend normal to said first fluid cylinder operating mechanisms.

* * * * *